US011186963B2

(12) United States Patent
Clearman

(10) Patent No.: US 11,186,963 B2
(45) Date of Patent: Nov. 30, 2021

(54) LOADER BUCKET BRACKETS

(71) Applicant: Hardparts Design, LLC, Knoxville, TN (US)

(72) Inventor: Ryan Clearman, Knoxville, TN (US)

(73) Assignee: Hardparts Design, LLC, Knoxville, TN (US)

( * ) Notice: Subject to any disclaimer, the term of this patent is extended or adjusted under 35 U.S.C. 154(b) by 0 days.

(21) Appl. No.: 16/808,773

(22) Filed: Mar. 4, 2020

(65) Prior Publication Data

US 2020/0283990 A1 Sep. 10, 2020

Related U.S. Application Data

(60) Provisional application No. 62/815,612, filed on Mar. 8, 2019.

(51) Int. Cl.
*E02F 3/40* (2006.01)
*E02F 3/96* (2006.01)

(52) U.S. Cl.
CPC ..... *E02F 3/40* (2013.01); *E02F 3/962* (2013.01)

(58) Field of Classification Search
None
See application file for complete search history.

(56) References Cited

U.S. PATENT DOCUMENTS

| | | | | |
|---|---|---|---|---|
| 1,303,346 | A * | 5/1919 | McFeaters | F16L 3/24 248/72 |
| 2,969,966 | A * | 1/1961 | Matheis | E02F 5/305 299/26 |
| 8,607,481 | B1 * | 12/2013 | Lukasko | E01H 5/066 37/232 |
| 8,985,934 | B1 * | 3/2015 | Jennison | B66F 9/075 414/724 |
| 9,267,265 | B1 * | 2/2016 | Pastuch | E02F 3/962 |
| 2004/0010948 | A1 * | 1/2004 | Humphrey | E02F 3/962 37/403 |
| 2017/0037597 | A1 * | 2/2017 | McLoughlin | E02F 3/962 |

OTHER PUBLICATIONS

Northern Tool & Equipment—Weld-On Grab Hook—Model 6501.
Precision Manufacturing—Single Add A Grapple Model 111100—https://precisionmfg.com/single/.

* cited by examiner

*Primary Examiner* — Ronald P Jarrett
(74) *Attorney, Agent, or Firm* — Luedeka Neely Group, P.C.

(57) ABSTRACT

A bracket for installation onto a bucket of a front end loader. The bracket is configured for installation and removal from the bucket without the use of a tool, and includes an inner member configured to be received by the bucket, an outer member configured to be located around portions of the inner member and the bucket, and a lock configured to extend through a portion of the inner member and the outer member when the bracket is installed onto the bucket to maintain the outer member and the inner member from moving relative to one another when installed onto the bucket.

25 Claims, 17 Drawing Sheets

LOADER BUCKET BRACKETS

FIELD

This disclosure relates to the field of attachments for mounting to a blade or bucket such as found on front end loaders of tractors, skid steers and the like. More particularly, this disclosure relates to tool-less and secure attachment of work implements such as hooks, trailer balls, forks, hitches, grapples, hydraulic cylinders, pivot points, hay spears, and the like to a bucket or blade of a front end loader or the like.

BACKGROUND

Improvement is desired in devices and attachment of devices to buckets or blades of front end loaders (FEL) of the type used on tractors and skid steers. It is desired to attach devices such as hooks, trailer balls, forks, hitches, grapples, hydraulic cylinders, pivot points, hay spears, and the like to the FEL bucket or blade. These attached devices enable additional uses of the FEL bucket or blade. For example, a chain may be secured to a hook attached to the FEL bucket or blade to pull a log, or a trailer may be secured to a trailer ball attached to the bucket, or forks attached to the bucket or blade may be used to lift pallets or brush.

Conventionally, hooks or a ball or the like are either bolted onto or welded to the FEL bucket or blade. As will be appreciated, these attachment methods provide a substantially permanent attachment of the devices or at least require tools in the case of bolted on attachments to install and remove the devices. Bolted devices are also undesirable as they require drilling of holes through the bucket. This is inconvenient and the devices typically are left on the FEL bucket or blade due to the time and effort required for installation or removal. Further, over time, it has been observed that bolts typically become loose and require periodic tightening which is inconvenient. Also, bolted or welded devices are not adjustably positionable as they are fixed at the location of the weld or the holes drilled for installation. Drilling or welding on the loader bucket modifies and disfigures the bucket from its stock form with potentially negative impact on the warranty, structural integrity, and resale value. Modification of the bucket generally requires paint repair which is typically inferior to the original finish allowing premature environmental deterioration and an unsightly appearance.

Leaving the devices on the FEL bucket or blade permanently, such as when welded on, is undesirable, as the attached devices can encumber or become damaged during uses of the bucket such as digging, scraping, and the like. Having multiple attached devices at any given time is also undesirable.

The present disclosure advantageously provides apparatus that enables tool-less and secure attachment of devices such as hooks, trailer balls, forks and the like to the FEL bucket or blade. Further advantages include such ease of installation and removal so that the devices may be installed for use and then removed. Devices according the disclosure are also adjustably positionable and do not require holes or other modification of the bucket or blade for installation.

SUMMARY

The above and other needs are met by brackets for installation onto a work surface, such as a bucket or blade of a front end loader or the like. The brackets are configured for installation and removal from the work surface without the use of a tool.

In one aspect, the bracket includes an inner member configured to be received by the work surface, an outer member configured to be located around portions of the inner member and the work surface, and a lock configured to extend through a portion of the inner member and the outer member when the bracket is installed onto the work surface to maintain the outer member and the inner member from moving relative to one another when installed onto the work surface.

In another aspect, the disclosure relates to a method for installing and using a bracket relative to a work surface. The method includes the steps of: providing a bracket having an inner member configured to be received by the work surface, an outer member configured to be located around portions of the inner member and the work surface, installing the bracket onto the work surface by locating the inner member on the work surface and locating the outer member around portions of the inner member and the work surface, and positioning a lock to extend through a portion of the inner member and the outer member to complete installation of the bracket onto the work surface, wherein when the bracket is installed onto the work surface the bracket is movable relative to the work surface in the absence of a work load, and wherein during use of the bracket to perform work, a work load is applied to the bracket to pinch the work surface between the inner member and the outer member and securely retain the bracket against movement relative to the work surface.

In another aspect, unwanted slack and or movement during the absence of a workload may be eliminated by applying tension or pre-loading the bracket through use of a threaded fastener to apply pressure from the bracket inner or outer member to the work surface or between the inner and outer members themselves.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
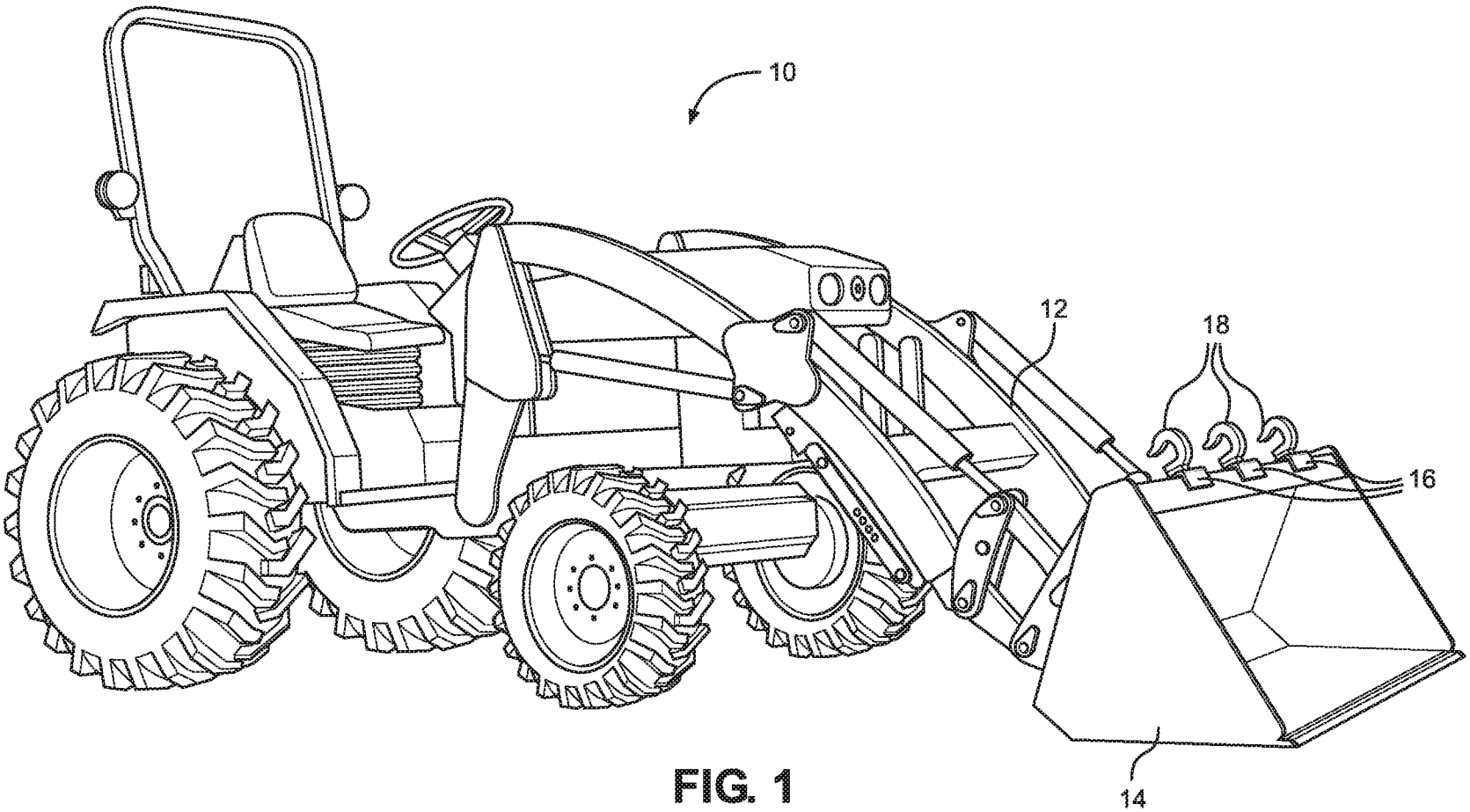
FIG. 1 shows a tractor having a front end loader with a bucket having brackets according to the disclosure installed thereon.

With initial reference to FIG. 1-4, there is shown a vehicle such as a tractor 10 having a front-end loader 12 with a work surface in the form of a rigid member such as a blade or bucket 14 having brackets 16 according to the disclosure installed thereon. Each bracket 16 has thereon or connected to it a work implement 18 such as a hook, trailer ball, fork or the like.

The disclosure is described in connection with a tractor having a front-end loader with a work surface such as a blade or bucket. It will be appreciated that the brackets described herein may be installed on a variety of work surfaces of a variety of vehicles. For example, the brackets 16 may be installed on a blade or other work surface attached to a three-point hitch or a tractor, or a blade of a bulldozer, or a bucket of a skid steer, or a blade or the like attached to a truck or an all-terrain vehicle or utility vehicle.

Figure 2:
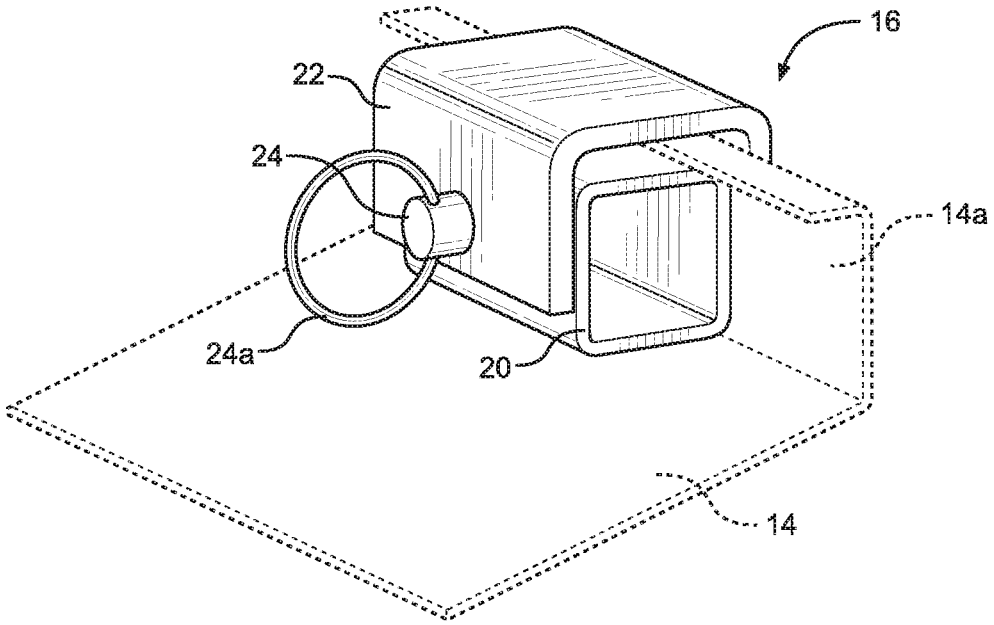
FIGS. 2 and 3 show a bracket according to the disclosure and its installation onto a loader bucket.
Figure 3:
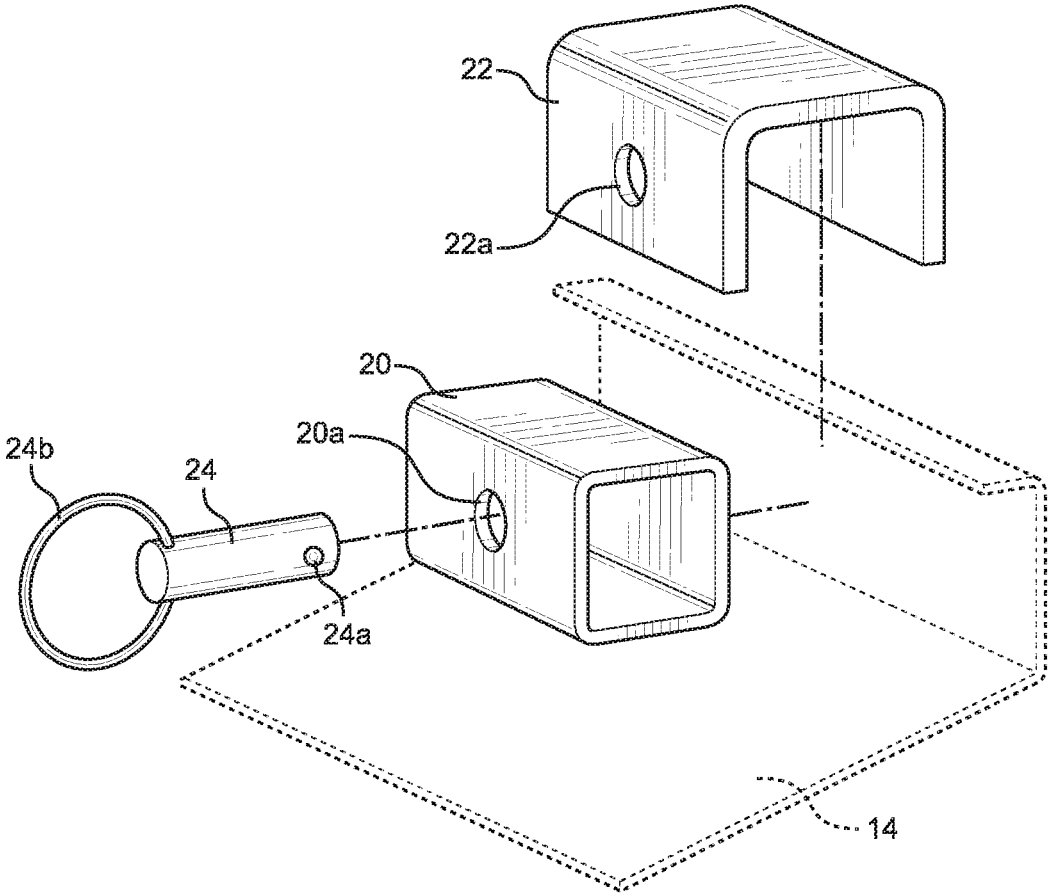

The bracket 16 is advantageously configured to enable secure attachment of the bracket 16 to the bucket 14 without the use of tools. FIGS. 2 and 3 show the bracket 16 and its installation onto the bucket 14. The bracket 16 includes an inner member 20 configured to be received by a corresponding surface 14A of the bucket 14 and an outer member 22 is located around portions of the inner member 20 and the bucket 14 and locked in place with a fastener such as a pin 24, or screw device such as a threaded fastener in the form of a screw or a bolt. The inner member 20, the outer member 22 and the pin 24 are desirably made of steel or like durable material.

The inner member 20 includes a surface configured to conform to the contour of the surface 14A. As shown, the inner member 20 is configured as a square, rectangular cylinder. The inner member 20 includes an aperture 20A in a sidewall thereof configured for receiving the pin 24 and/or a threaded fastener. The aperture 20A is desirably smooth for use with the pin 24 and is threaded for use with the threaded fastener, although a threaded aperture may be use used with the pin 24.

The outer member 22 is configured as an elongate u-channel having a length corresponding to the length of the inner member 20. The outer member 22 includes an aperture 22A in a sidewall thereof located to align with the aperture 20A of the inner member 20 and to receive the pin 24.

The pin 24 is configured to pass through the aligned apertures 20A and 22A of the inner member 20 and the outer member 22 during installation of the bracket 16 and to lock the inner member 20 and the outer member 22 from relative movement when the bracket 16 is securely installed on the bucket 14. The pin 24 may be a quick release pin having a spring-loaded ball 24A at its distal end and a ring 24B at its proximal end, a pin with a "hairpin" style clip or linchpin at its distal end and a flange at it proximal end, or a screw device such as a threaded fastener threaded into the inner or outer member or both. The ball 24A serves to maintain the pin 24 installed unless deliberately grasped and removed.

The bracket 16 is installed on the bucket 14 as by positioning the inner member 20 against the surface 14A of the bucket 14, placing the outer member 22 over portions of the bucket 14 and the inner member 20 so that the aperture 22A of the outer member 22 is aligned with the aperture 20A of the inner member 20, with a portion of the bucket 14 captured between opposing surfaces of the inner member 20 and the outer member 22. The pin 24 is then installed through the aligned apertures 20A and 22A to secure the bracket 16 to the bucket 14. The bracket 16 as installed may be adjusted to a desired position along the bucket 14 by sliding as the bracket 16.

When pressure is applied to the bracket 16, as during use of the bracket 16 on the bucket 14, the cooperating structures of the outer member 22 and the inner member 20 cooperate to pinch the outer member 22 and the inner member 20 against the portion of the bucket 14 located between the inner member 20 and the outer member 22 to securely fix the bracket 16 against movement. For example, when a chain is connected to the work implement, such as the hook 18, to pull a log, the weight of the log supplies force or pressure, referred to herein as a work load, to tighten the chain and pinch the bracket 16 against the bucket 14 to frictionally secure the position of the bracket 16.

When the bracket 16 is not in use so as to be under a work load, the bracket 16 is not pinched against the bucket 14 and the bracket 16 may be freely slid along the bucket 14 to enable the bracket 16 to be positioned in multiple locations along the bucket 14 as desired. Unwanted slack and or movement during the absence of a workload may be eliminated by applying tension or pre-loading the bracket through use of a threaded fastener to apply pressure from the bracket inner 20 or outer member 22 to the bucket 14 or between the inner member 20 and outer member 22 themselves.

Figure 4:
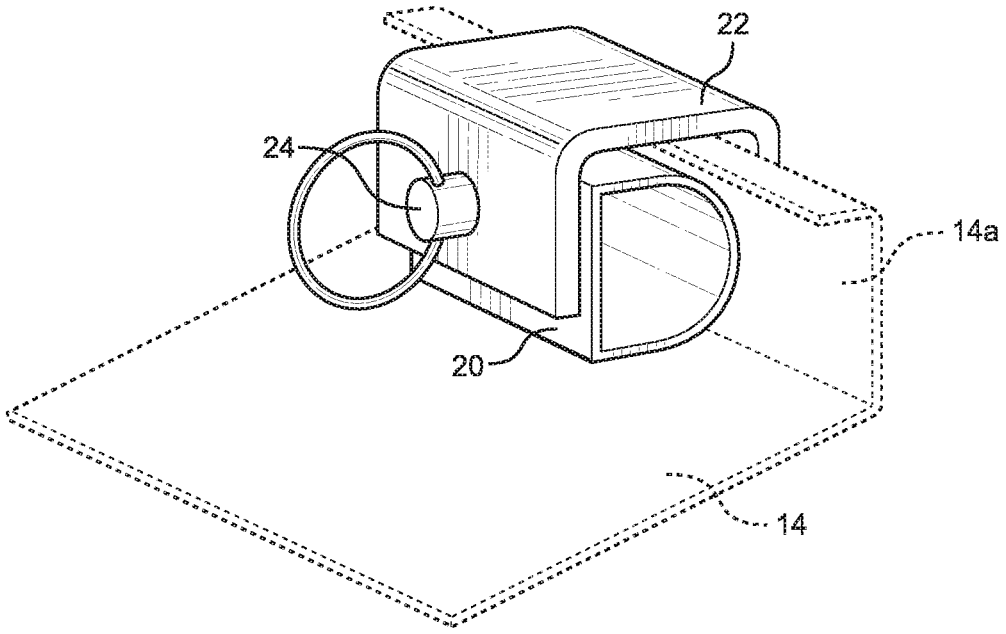
FIGS. 4 and 5 show another embodiment of a bracket according to the disclosure and its installation onto a loader bucket.
Figure 5:
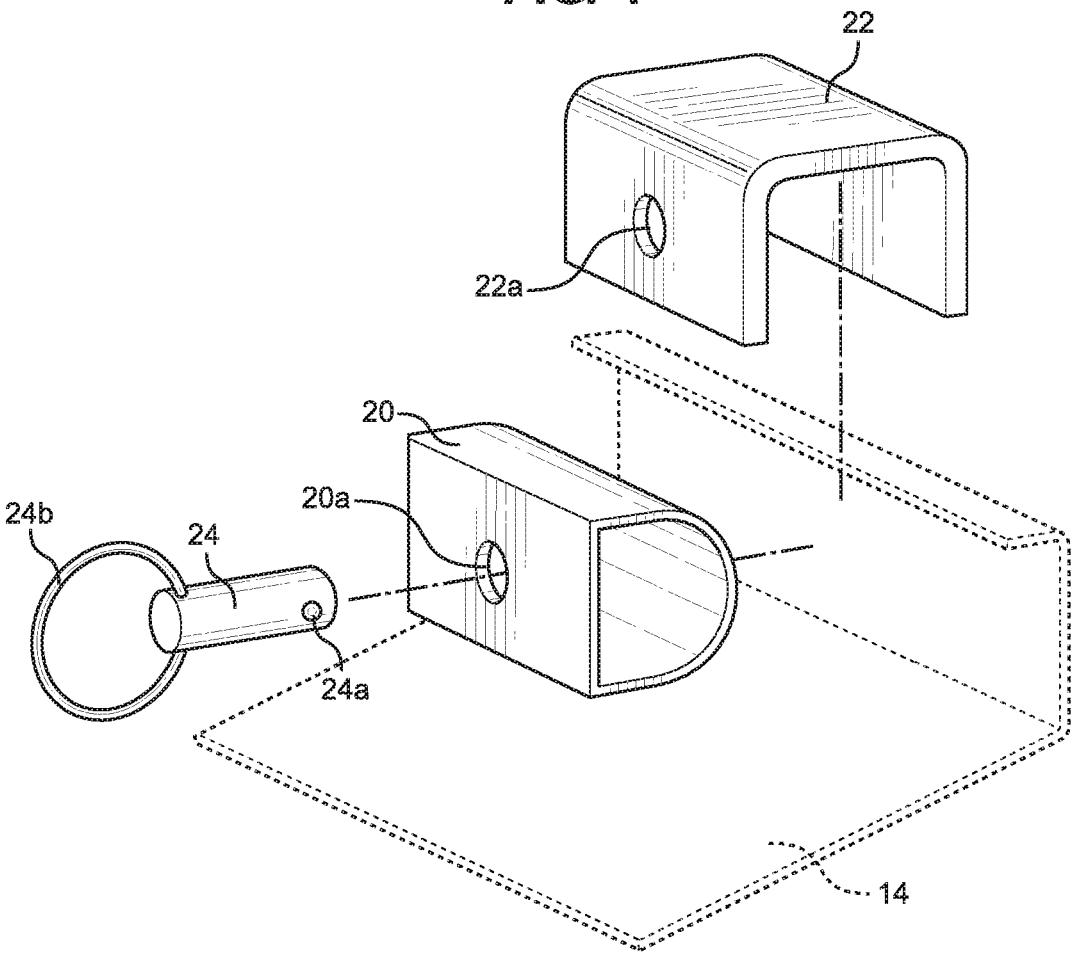

FIGS. 4 and 5 show another embodiment of the bracket 16 according to the disclosure and its installation onto a loader bucket. The bracket 16 shown in FIGS. 4 and 5 is substantially identical to the bracket described in connection with FIGS. 2 and 3, except the inner member 20 is configured as a rectangular cylinder with an outwardly curved sidewall.

Figure 6:
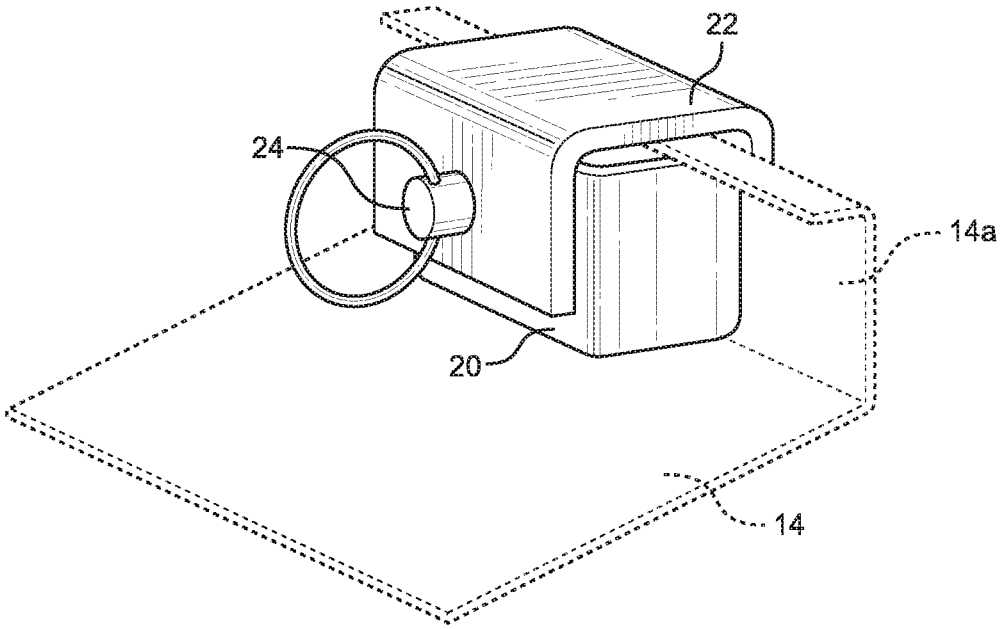
FIGS. 6 and 7 show a further embodiment of a bracket according to the disclosure and its installation onto a loader bucket.
Figure 7:
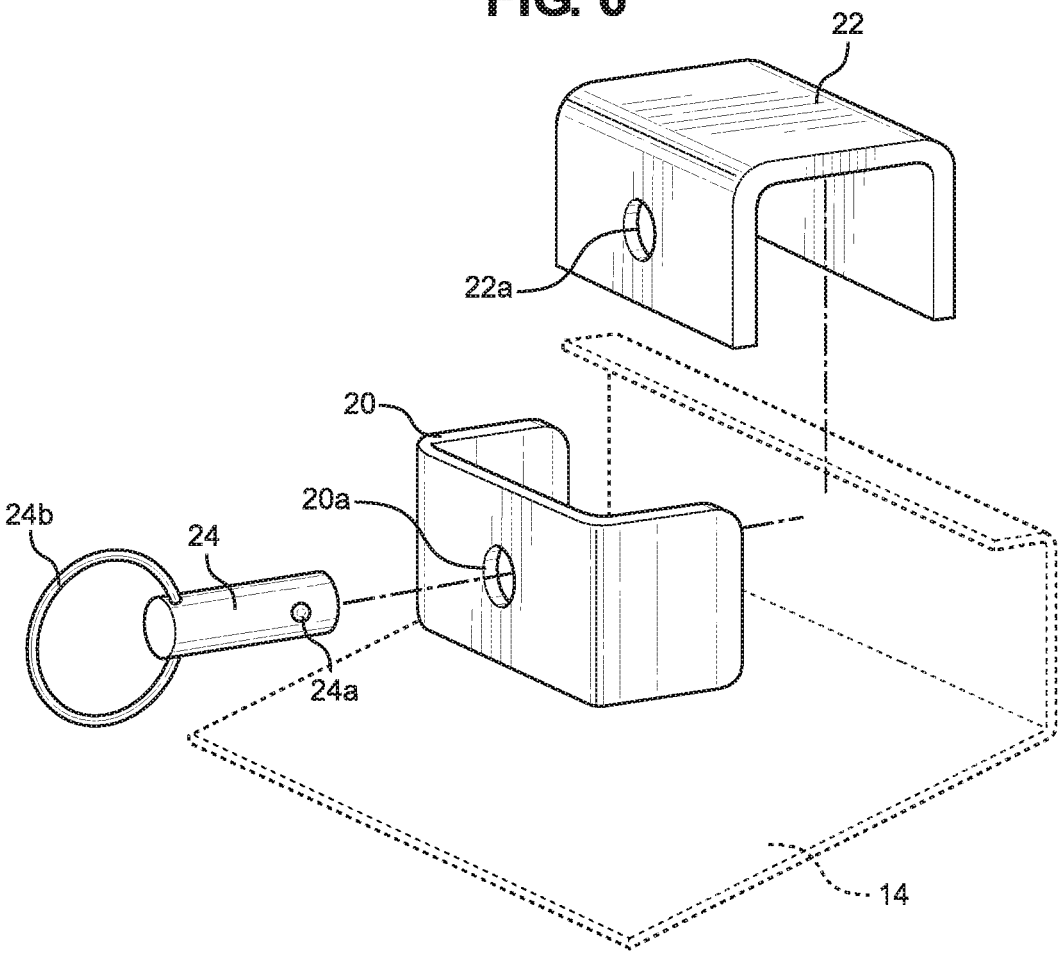

FIGS. 6 and 7 show a further embodiment of a bracket 16 according to the disclosure and its installation onto a loader bucket. The bracket 16 shown in FIGS. 4 and 5 is similar in construction to the previously described brackets, except the inner member 20 is configured as a u-shaped member having the legs of the u-shape defining the ends of the inner member 20.

Figure 8:
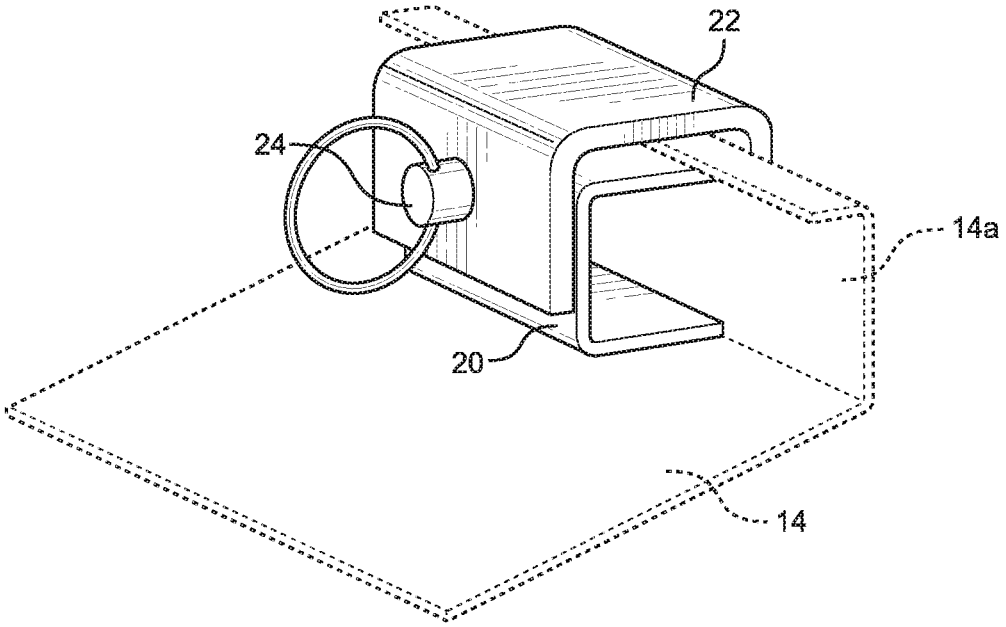
FIGS. 8 and 9 show a still further embodiment of a bracket according to the disclosure and its installation onto a loader bucket.
Figure 9:
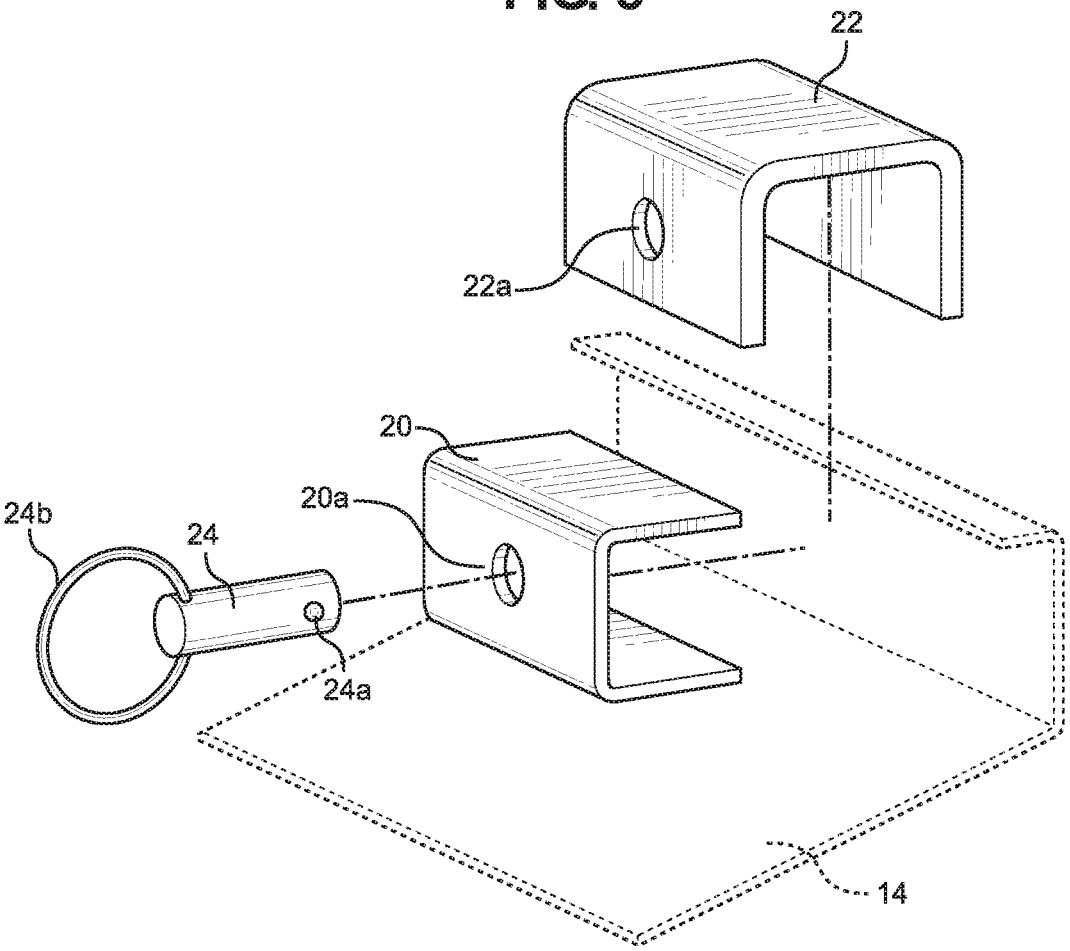

FIGS. 8 and 9 show a still further embodiment of a bracket 16 according to the disclosure and its installation onto a loader bucket. The bracket 16 shown in FIGS. 8 and 9 is similar in construction to the previously described brackets, except the inner member 20 is configured as a u-shaped member having the legs of the u-shape defining the sidewalls of the inner member 20.

Figure 10:
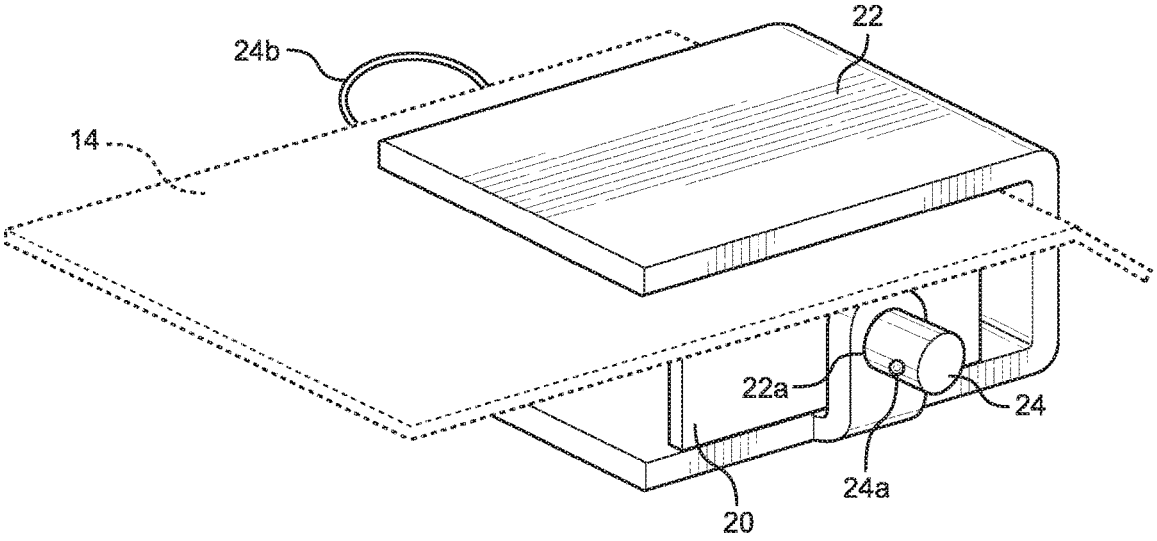
FIGS. 10 and 11 show yet another embodiment of a bracket according to the disclosure and its installation onto a loader bucket.
Figure 11:
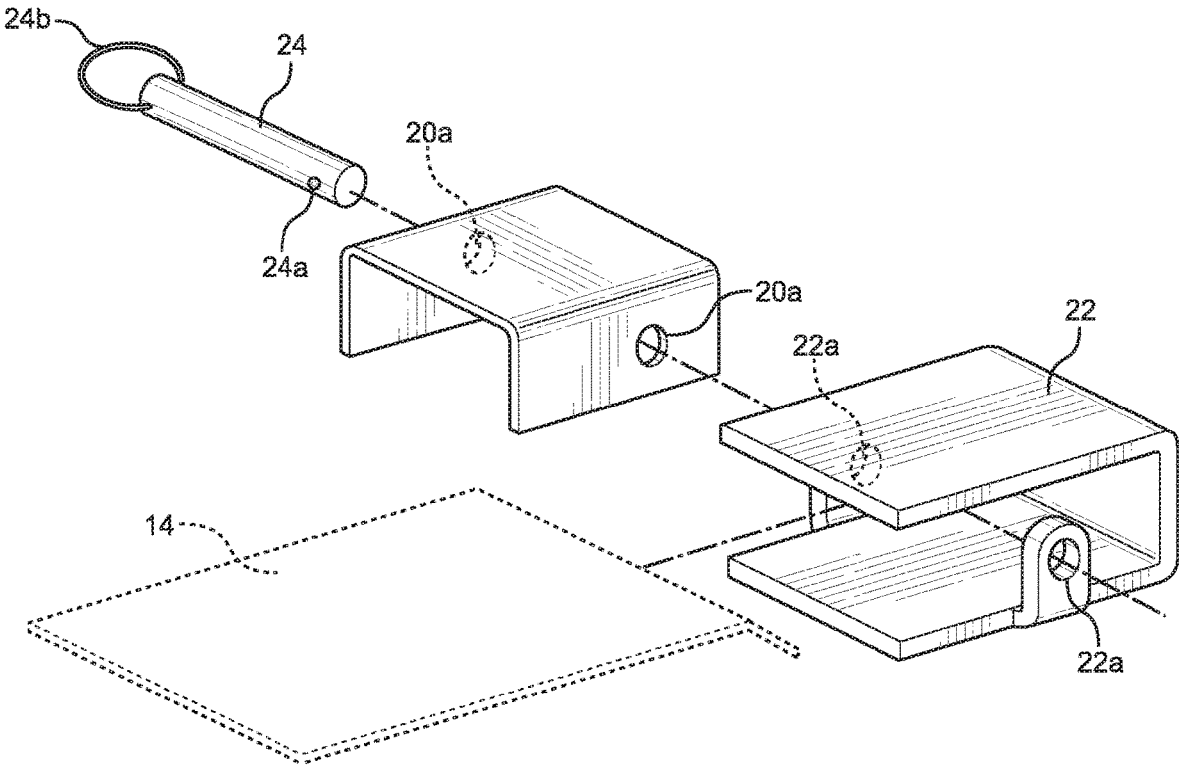

FIGS. 10 and 11 show yet another embodiment of a bracket 16 according to the disclosure and its installation onto a loader bucket. The bracket 16 shown in FIGS. 4 and 5 is similar in construction to the previously described brackets, except the inner member 20 and the outer member 22 are configured to be installed on an edge of the bucket 14 such as is found on a bottom edge of a loader bucket or the top edge of loader buckets or blades of an alternative construction type.

The inner member 20 is generally u-shaped or rectangular shaped with the ends of the u-shape or rectangle forming the ends of the inner member 20, with one of the apertures 20A formed in each of the ends and aligned with one another.

The outer member 22 is also generally u-shaped and includes a pair of the apertures 22A formed on upstanding members on opposite edges of the outer member 22 locatable to align with the apertures 20A of the inner member 20. The pin 24 is sufficiently long to extend through the aligned sets of the apertures 20A and 22A.

Figure 12:
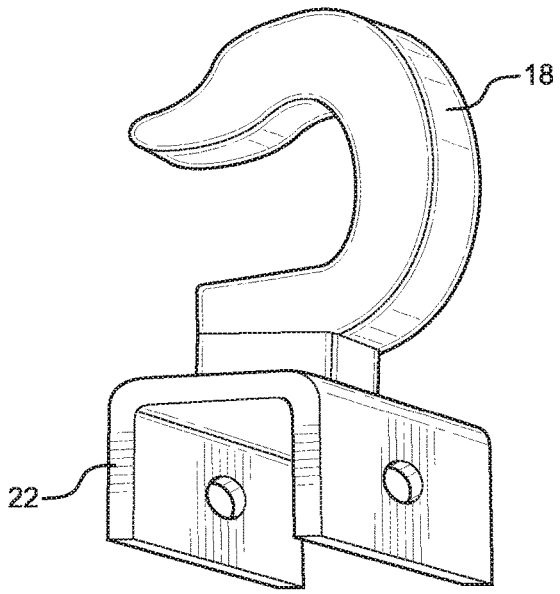
FIGS. 12-14 show brackets according to the disclosure configured to include various work implements.
Figure 13:
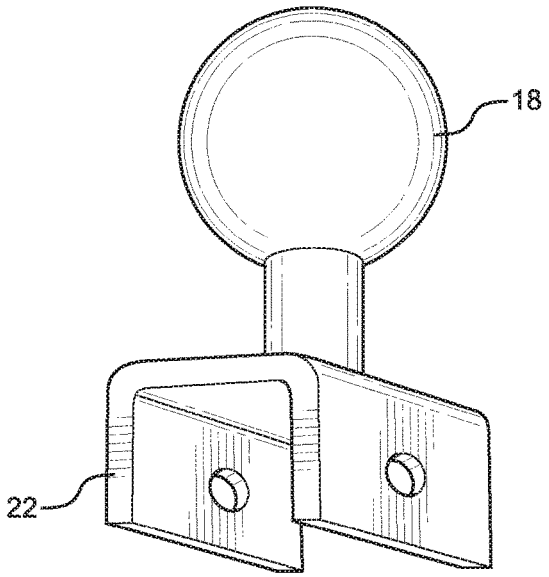
Figure 14:
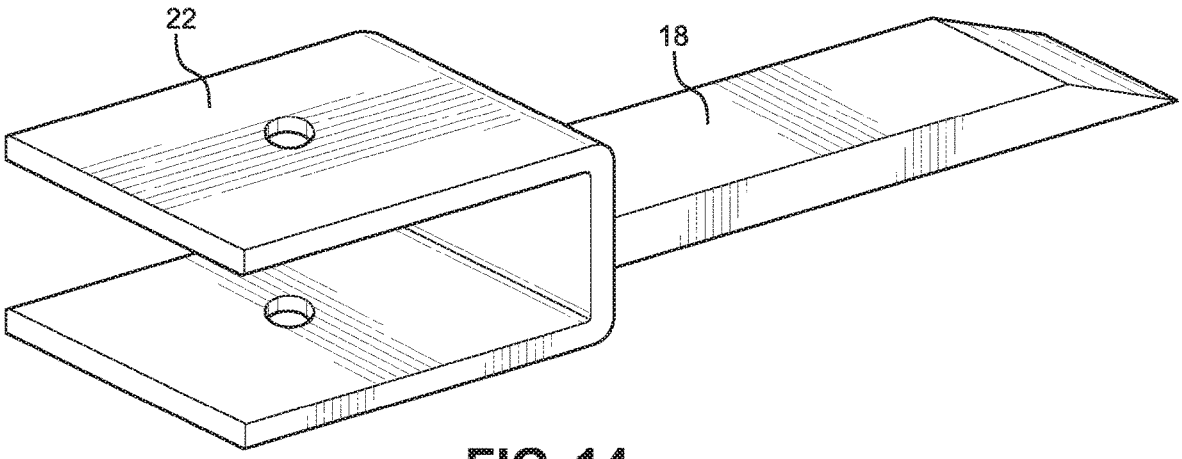

FIGS. 12-14 show brackets according to the disclosure configured to include various work implements 18. FIG. 12 shows the work implement 18 located on the outer member 22 to be a hook. FIG. 13 shows the work implement 18 to be a trailer ball. FIG. 14 shows the work implement 18 to be a fork. The work implement 18 may be configured to provide a wide variety of work implements.

Each of the brackets 16 described herein is mounted in a manner similar to that described in connection with the embodiment of FIGS. 2-3, with the bracket being configured to be able to slidingly adjust once installed, but locked in place by pinching when placed under load during use or when tension is applied using a pre-loading mechanism.

Figure 15:
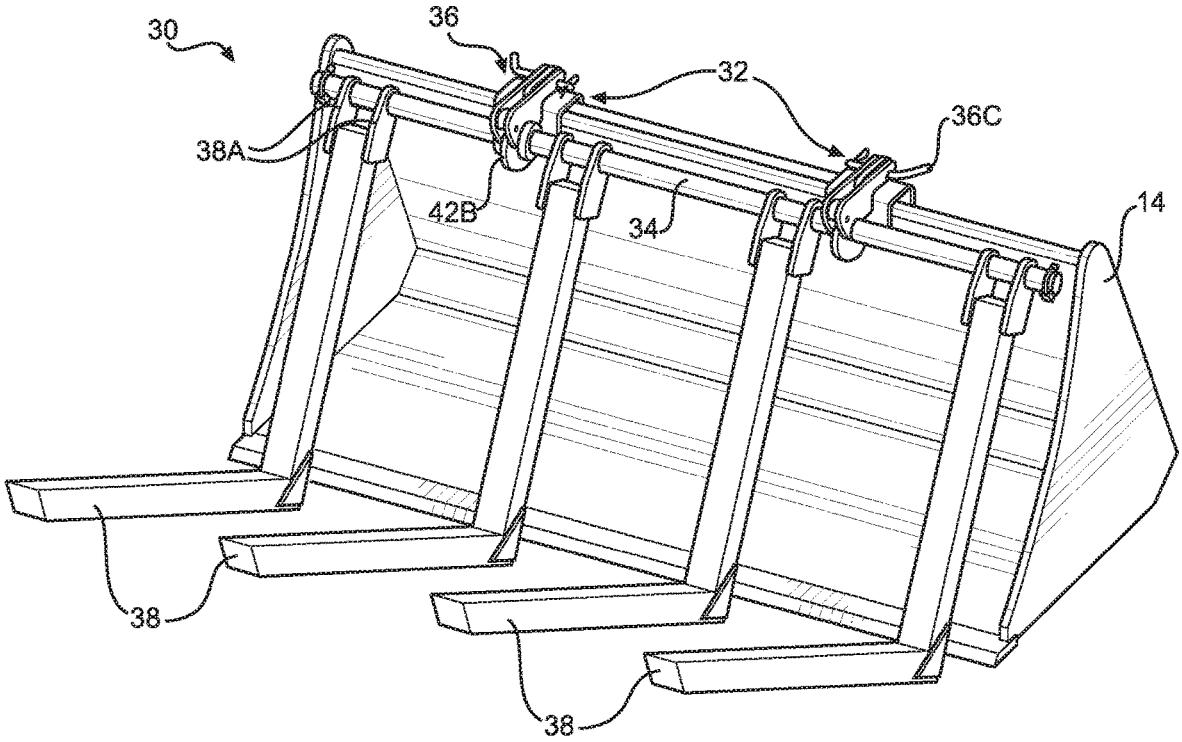
FIGS. 15-17 show a bracket system according to the disclosure for installation onto a loader bucket to provide a pivot point and plurality of forks.
Figure 16:
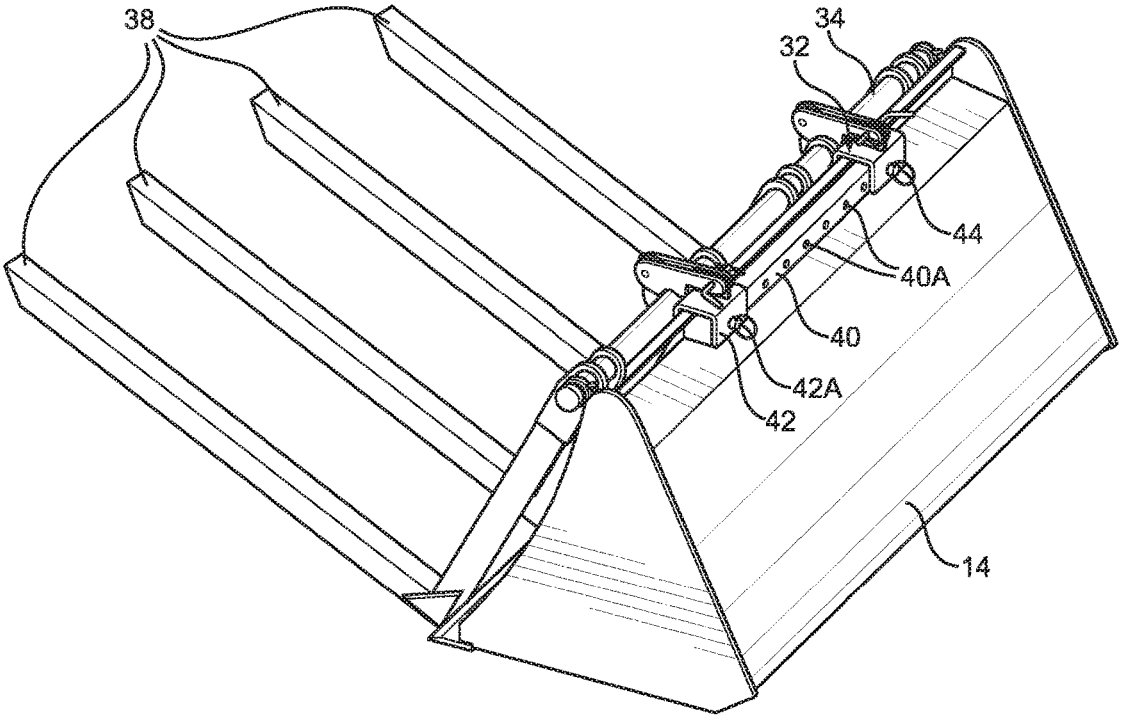
Figure 17:
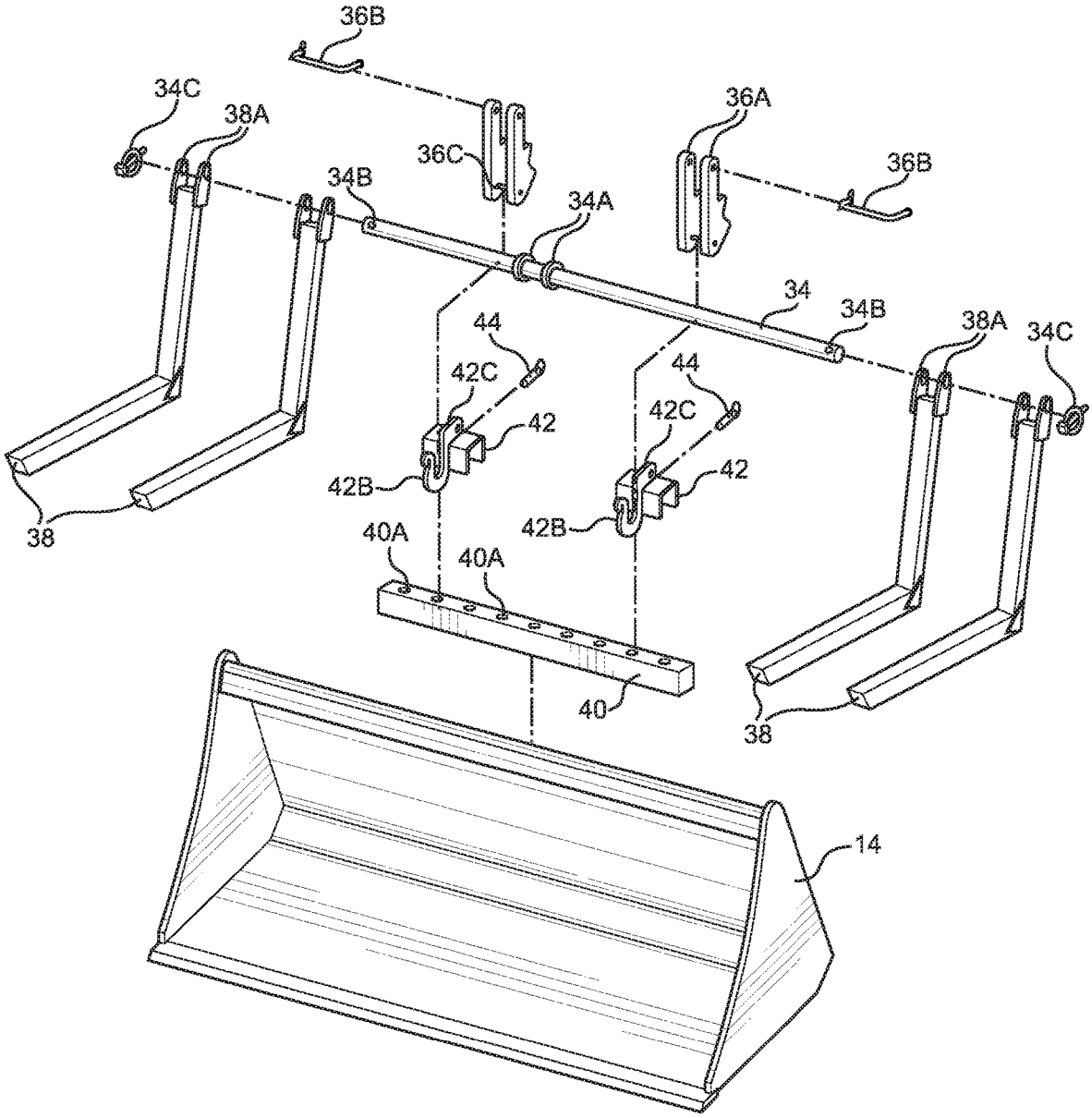

Turning now to FIGS. 15-17, there is shown a fork system 30 for installation onto the bucket 14 without the use of tools. The fork system 30 includes brackets 32, a bar 34, bar locks 36, and work implements in the form of forks 38.

The brackets 32 each include an inner member 40 configured to be received by the corresponding surface of the bucket 14 and an outer member 42 located around portions of the inner member 40 and the bucket 14 and locked in place with a pin 44 that extends through an aperture 40A of the inner member 40 aligned with an aperture 42A of the outer member 42.

The outer member 42 includes a hook-shaped bar receiver 42B and a lock mount 42C to which the bar lock 36 is pivotally mounted. The bar 34 includes a pair of lateral retaining rings 34A and apertures 34B at the opposite ends to receive retaining pins 34C. The bar 34 is received by the bar receivers 42B and the locks 36 maintain the bar 34 within the receivers 42B. The retaining rings 34A are located to be on either side of one of the bar receivers 42B and the bar lock 36 so as to maintain the longitudinal position of the bar 34 relative to the receiver 42B.

The bar lock 36 as shown is provided as by a pair of spaced apart plates 36A that pivotally mount to the bar receiver 42B and lock mount 42C by pins 36B and having a connecting rod or catch 36C extending therebetween which latches to a surface of the bar receiver 42B so as to hold the bar 34 within the bar receiver 42B.

The forks 38 are L-shaped with bar mounts 38A at the upper ends of the forks 38. The bar 34 is located through the bar mounts 38A to mount the forks 38 to the bar 34.

Figure 18:
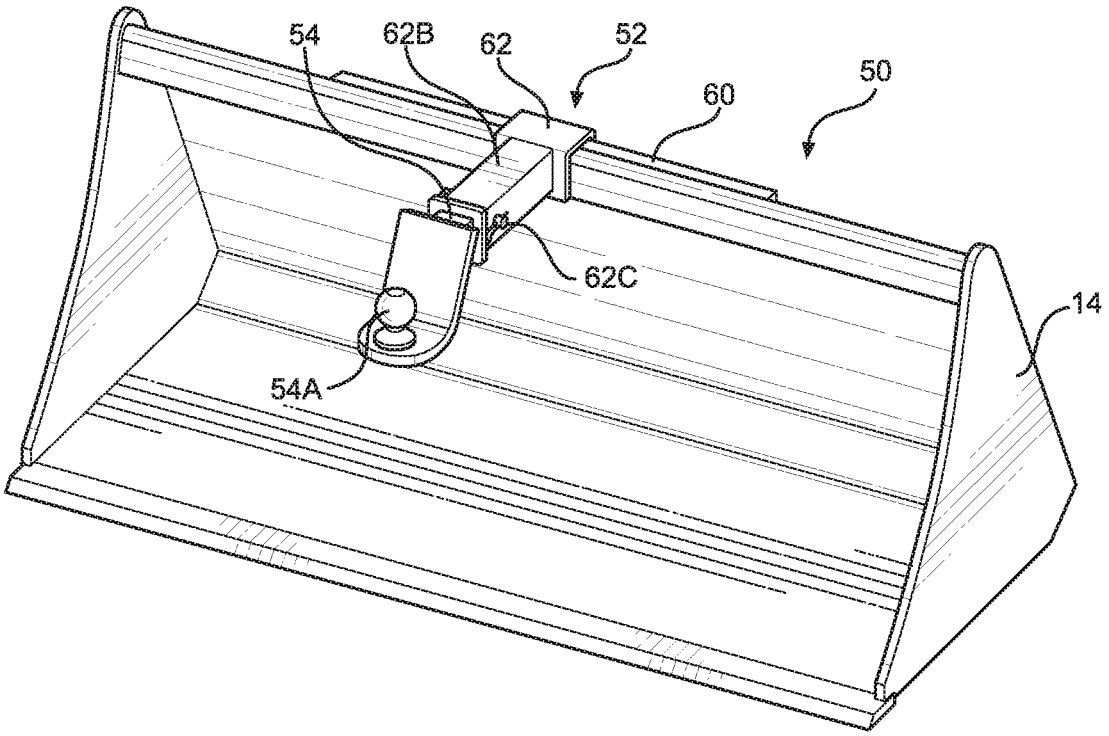
FIGS. 18-20 show a bracket system according to the disclosure for installation onto a loader bucket to provide a multi-use hitch style receiver.
Figure 19:
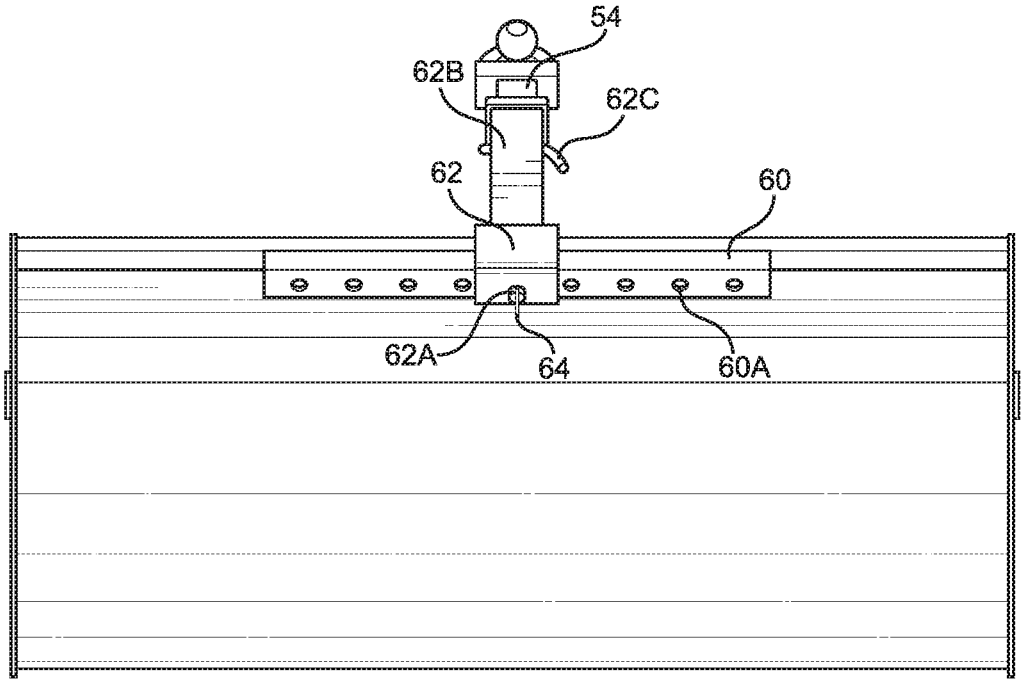
Figure 20:
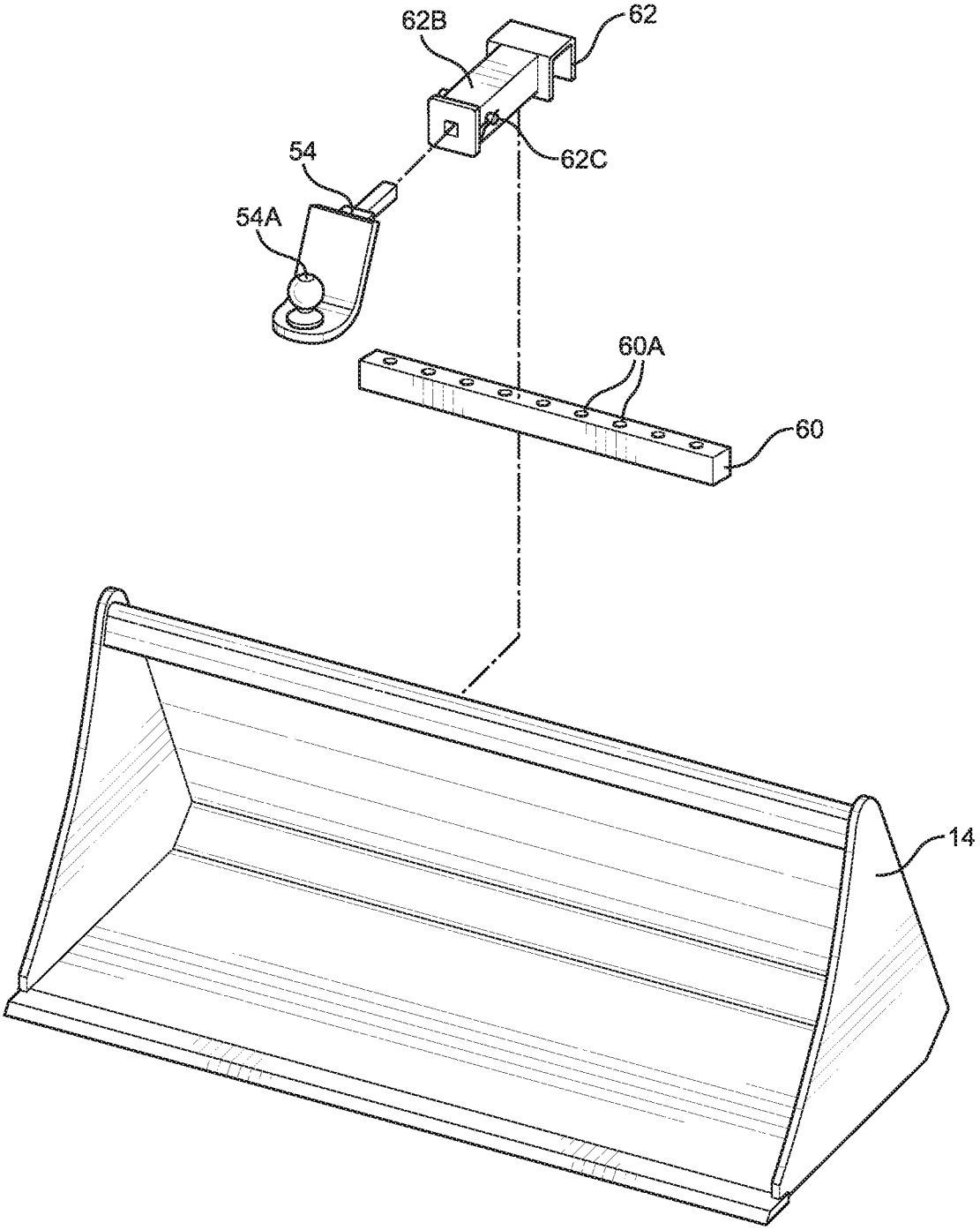

Turning now to FIGS. 18-20 there is shown a hitch system 50 for installation onto the bucket 14 without the use of tools. The hitch system 50 includes a bracket 52 and a receiver hitch 54 having a hitch ball 54A as a work implement.

The bracket 52 includes an inner member 60 configured to be received by the corresponding surface of the bucket 14 and an outer member 62 located around portions of the inner member 60 and the bucket 14 and locked in place with a pin 64 that extends through an aperture 60A of the inner member 60 aligned with an aperture 62A of the outer member 62.

The outer member 62 includes a receiver 62B into which the receiver hitch 54 is received. The receiver hitch 54 is locked to the receiver 62B as by a hitch pin 62C.

Figure 21:
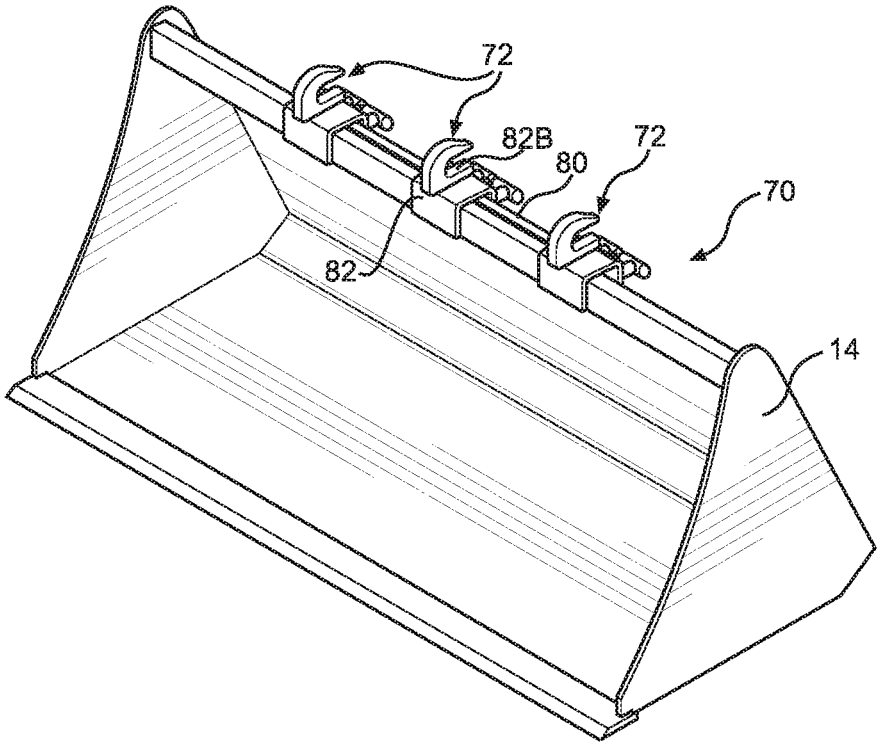
FIGS. 21-23 show a bracket system according to the disclosure for installation onto a loader bucket to provide a plurality of hooks.
Figure 22:
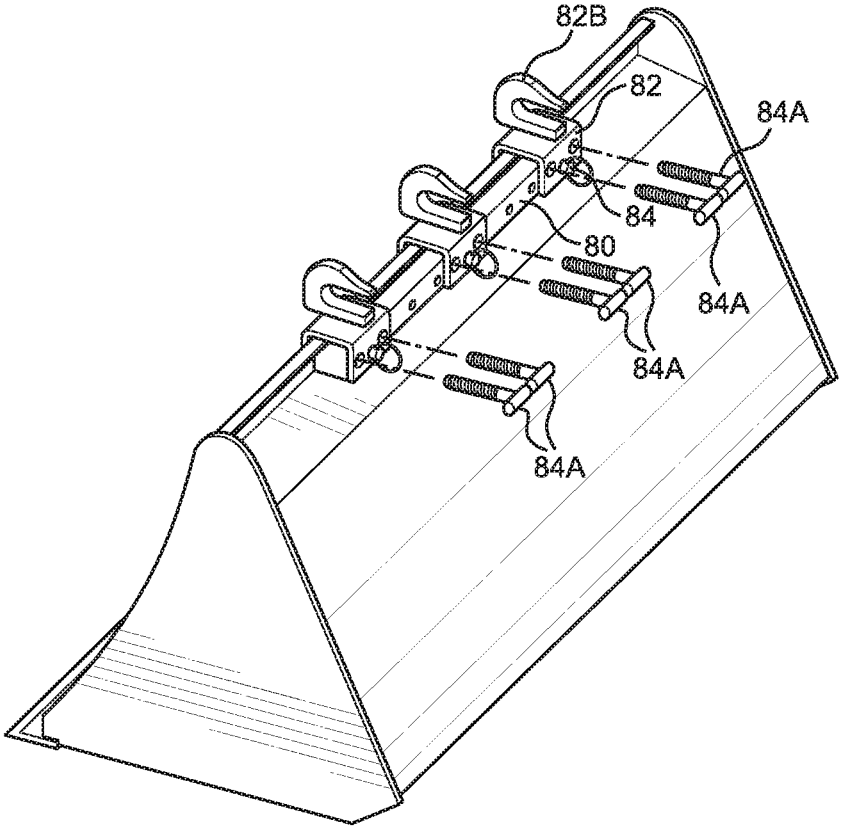
Figure 23:
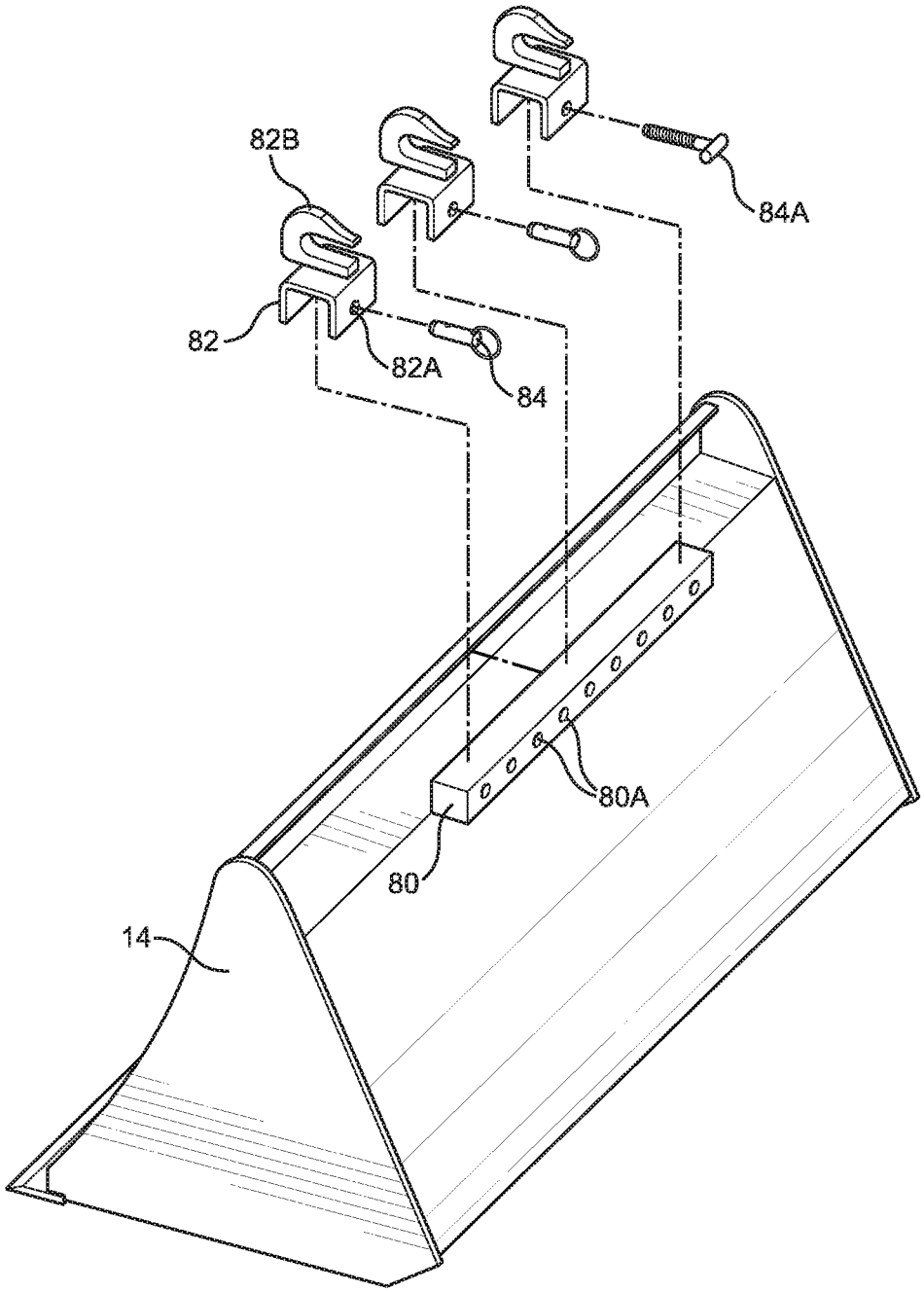
Figure 24:
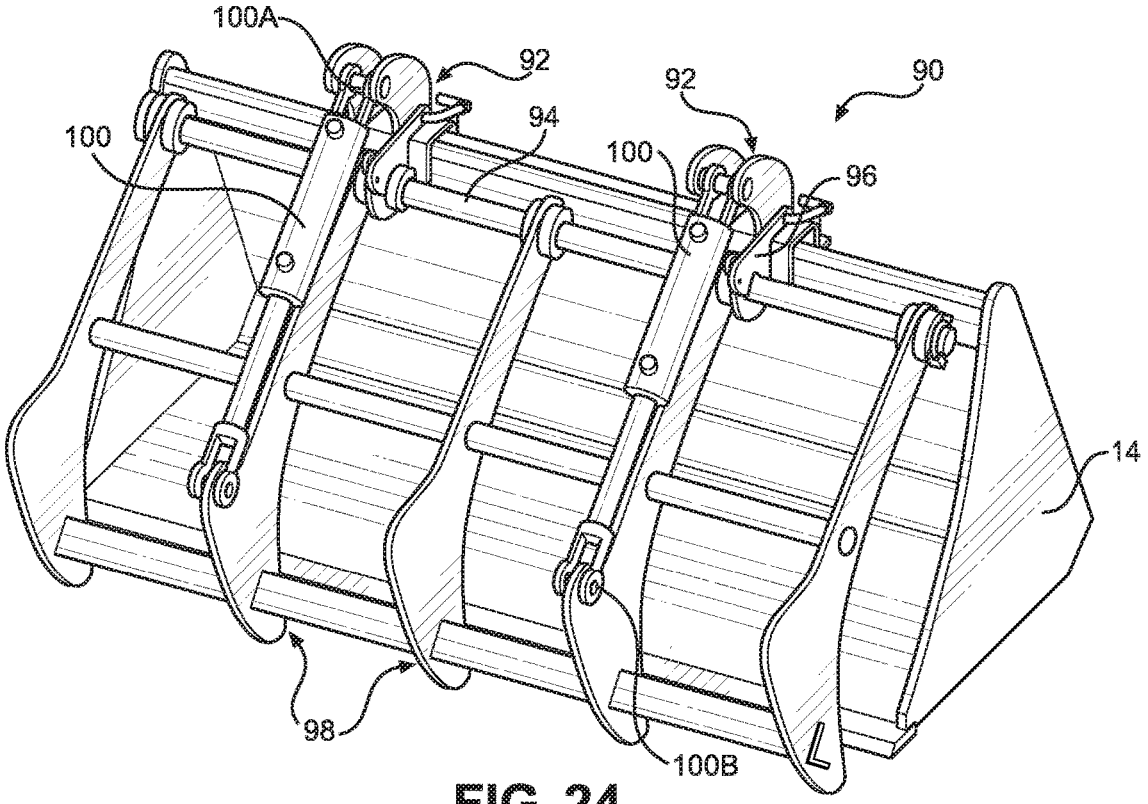
FIGS. 24-28 show a bracket system according to the disclosure for installation onto a loader bucket to provide a hydraulic grapple assembly.
Figure 25:
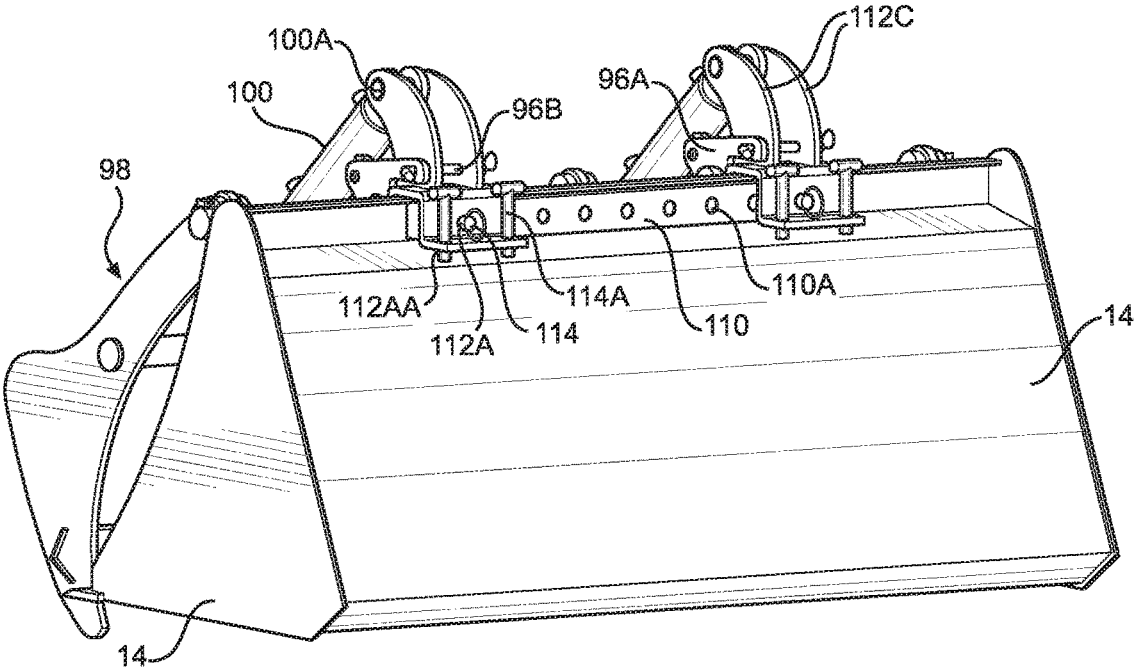
Figure 26:
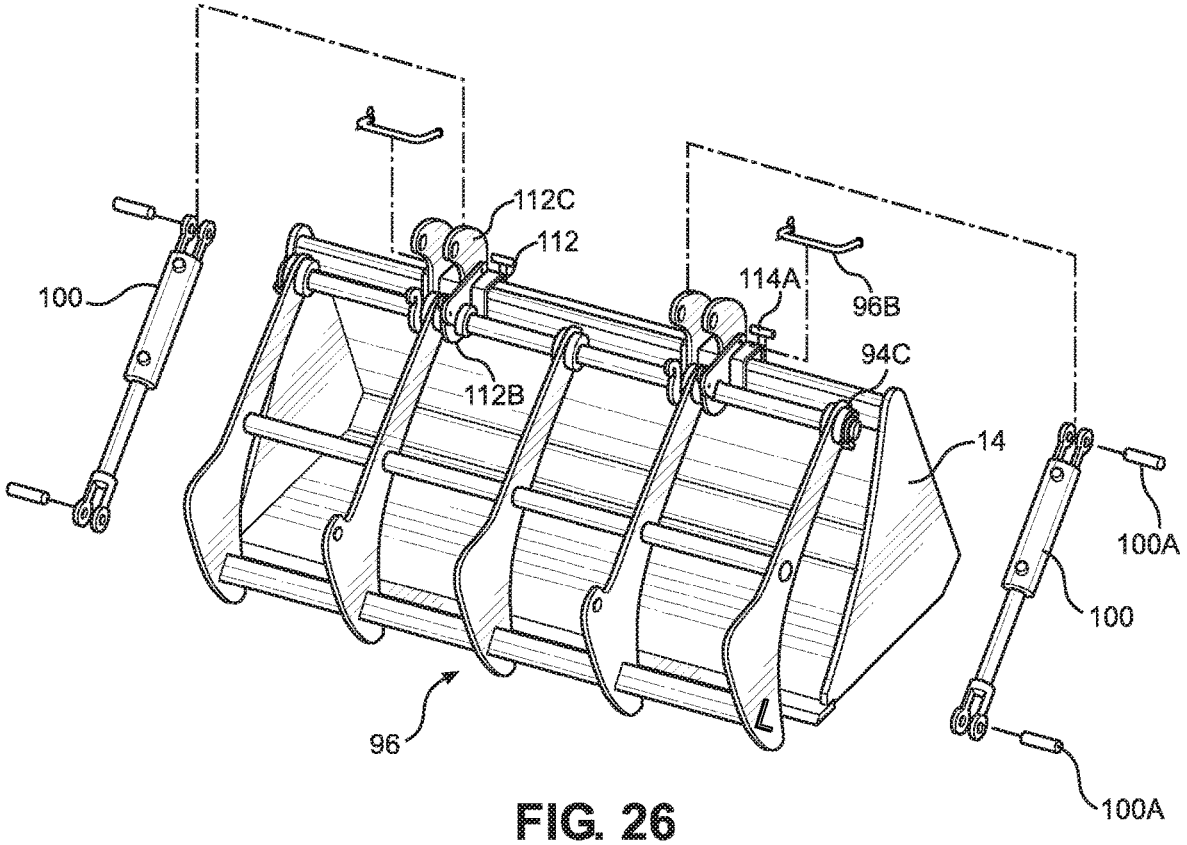
Figure 27:
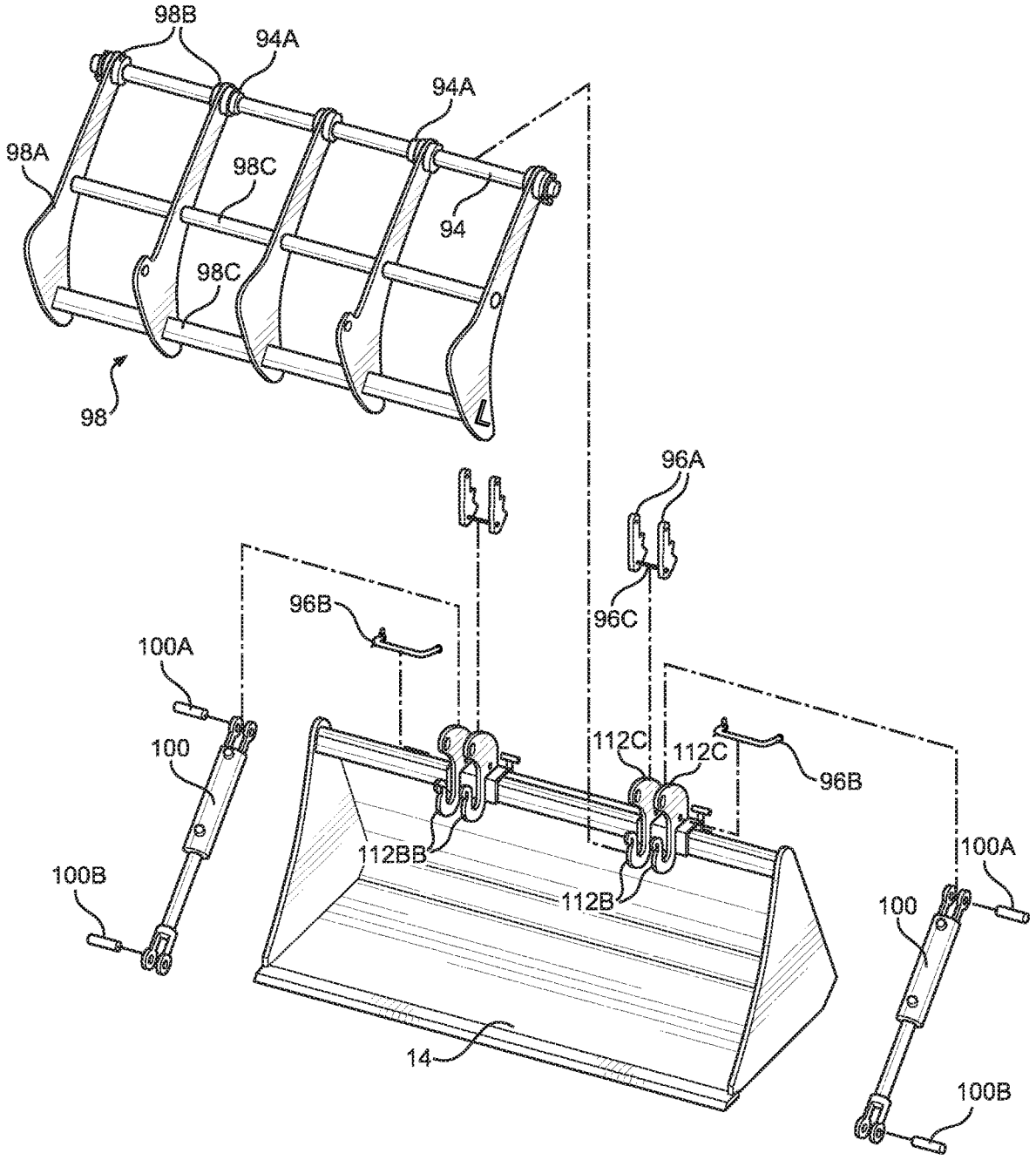
Figure 28:
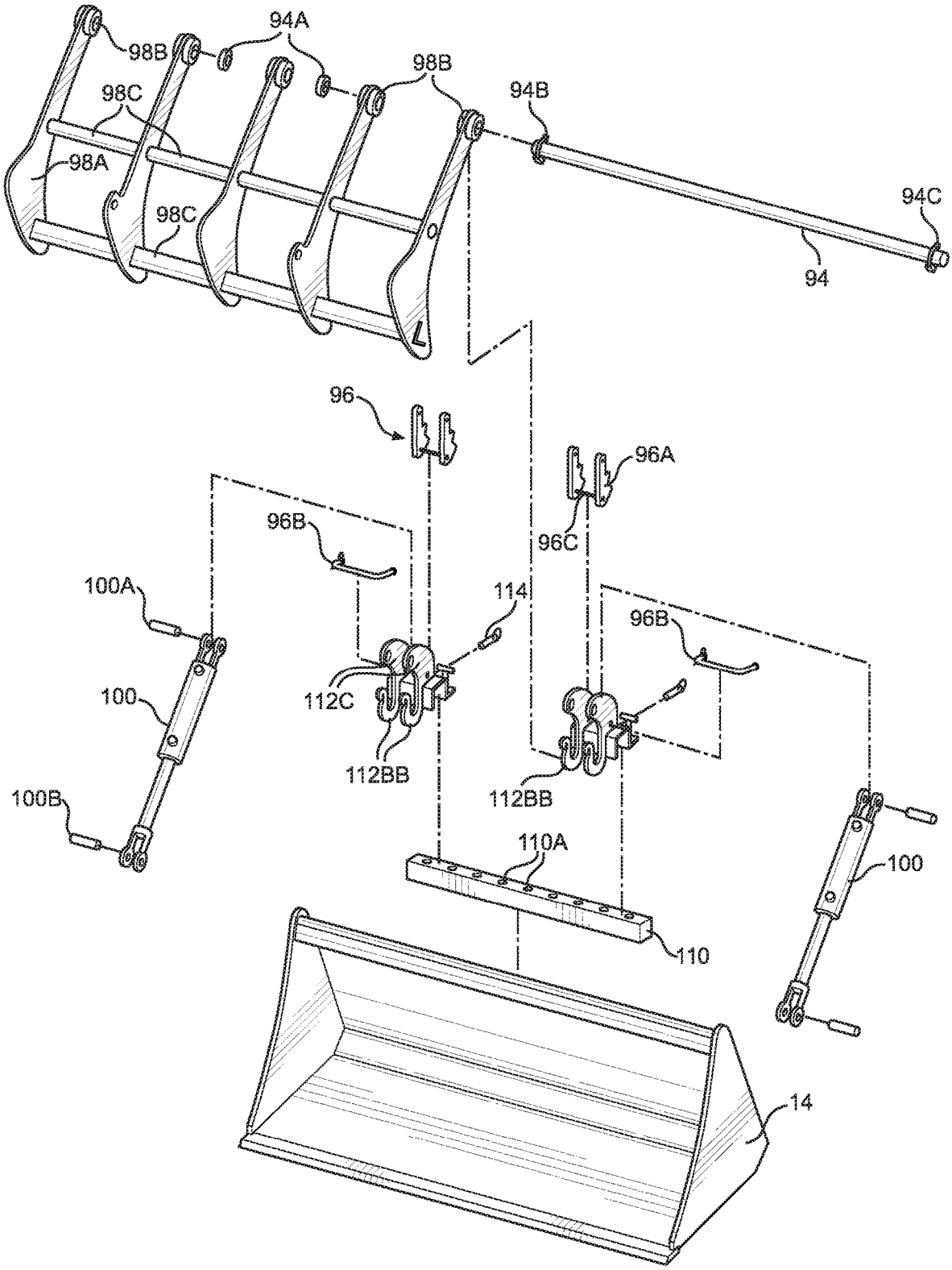

Turning now to FIGS. 21-23 there is shown a hook system 70 according to the disclosure for installation onto the bucket 14 without the use of tools. The hitch system 70 includes a bracket 72 that includes an inner member 80 configured to be received by the corresponding surface of the bucket 14 and a plurality of outer members 82 located around portions of the inner member 80 and the bucket 14 and locked in place with pins 84 that extend through apertures 80A of the inner member 80 aligned with apertures 82A of the outer member 82. The outer members 82 include hooks 82B thereon as work implements.

The pins 84 may be a quick release, a pin with a "hairpin" style clip or linchpin at its distal end and a flange at it proximal end, or a screw device such as a threaded fastener 84A threaded into the inner or outer member or both. In such case, the aperture provided is threaded.

The threaded fasteners 84A may additionally be provided to thread through threaded apertures of the outer member 82 to bear against the inner member 80 or bucket 14 and further secure the outer member 82 to the inner member 80 and bucket 14.

Turning now to FIGS. 24-28 there is shown a grapple system 90 according to the disclosure for installation onto the bucket 14 without the use of tools. The grapple system 90 includes brackets 92, a bar 94, bar locks 96, grapple assembly 98, and hydraulic cylinders 100.

The brackets 92 each include an inner member 110 configured to be received by the corresponding surface of the bucket 14 and an outer member 112 located around portions of the inner member 110 and the bucket 14 and locked in place with a pin 114 that extends through an aperture 110A of the inner member 110 aligned with an aperture 112A of the outer member 112. Threaded adjustment fasteners, such as screws or bolts 114A may additionally be provided to thread through threaded apertures 112AA of the outer member 112 to bear against the inner member 110 or bucket 14 and further secure the outer member 112 to the inner member 110 and bucket 14.

The outer member 112 includes hook-shaped bar receivers 112B and mounts 112C to which the bar lock 96 and the hydraulic cylinder 100 is pivotally mounted. The bar 94 includes a pair of retaining rings 94A. The bar 94 is received by the bar receivers 112B and the locks 96 maintain the bar 94 within the receivers 112B. The removable retaining rings 94A are located to be on either side of one of the bar receivers 112B so as to maintain the longitudinal position of the bar 94 relative to the receiver 112B.

The bar 94 includes a pair of retaining rings 94A and apertures 94*b* at the opposite ends to receive retaining pins 94*c*.

Each of the bar locks 96 as shown is provided as by a pair of spaced apart plates 96*a* that pivotally mount to the mount 112C by pins 96B and having a connecting rod or catch 96C extending therebetween which latches to latch surfaces 112BB of the bar receivers 112B so as to hold the bar 94 within the bar receivers 112B.

The grapple assembly 98 provides a work implement and includes elongate tines 98A with bar mounts 98B at the upper ends of the tines 98A. The bar 94 is located through the bar mounts 98B to mount the tines 98A to the bar 94. Cross-members 98C extend lateral through aligned apertures of the tines 98A.

The upper ends of the hydraulic cylinders 100 are pivotally secured to the mounts 112C as by pins 100A that extend through aligned apertures of the mounts 112C and the cylinders 100. The lower ends of the hydraulic cylinders 100 are likewise pivotally secured to the mounts 112C as by pins 100B that extend through aligned apertures of the tines 98A and the cylinders 100. The hydraulic cylinders are connectable to a hydraulic system of the tractor and operatively associated with the loader bucket 14 to render the grapple system 90 operable as a grapple, to pivot open and closed relative to the bucket 14.

As will be appreciated, the brackets and the systems described herein may be readily installed and removed without the use of tools, and are easily adjusted when not under a work load, and are securely maintained in position during use due to pressure applied by a work load during use.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A bracket for installation onto a work surface, the bracket configured for installation and removal from the work surface without the use of a tool, the bracket comprising: an inner member configured to be received by the work surface, an outer member configured to be located around portions of the inner member and the work surface, and a lock configured to extend through a portion of the inner member and the outer member without extending through the work surface when the bracket is installed onto the work surface to securely install the bracket onto the work surface and maintain the outer member and the inner member from moving relative to one another when installed onto the work surface.

2. The bracket of claim 1, wherein the work surface comprises a bucket or a blade of a front end loader.

3. The bracket of claim 1, wherein during use of the bracket to perform work, a work load is applied to the bracket to pinch the work surface between the inner member and the outer member and securely retain the bracket against movement relative to the work surface.

4. The bracket of claim 3, wherein in the absence of the work load the work surface is not pinched between the inner member and the outer member and the bracket is movably positionable relative to the work surface.

5. The bracket of claim 1, wherein a threaded fastener applies force from the outer member to the inner member thereby clamping the work surface between the inner member and outer member preventing movement relative to the work surface in the absence of a load.

6. The bracket of claim 1, wherein a threaded fastener applies force from the inner member to the outer member thereby clamping the work surface between the inner member and outer member preventing movement relative to the work surface in the absence of a load.

7. The bracket of claim 1, wherein a threaded fastener applies force from the outer member to the work surface to remove additional clearance slack between the work surface and attached bracket.

8. The bracket of claim 1, wherein a threaded fastener applies force from the outer member to the work surface to prevent movement relative to the work surface in the absence of a load.

9. The bracket of claim 1, wherein the lock comprises a pin that extends through an aperture of the outer member and an aperture of the inner member.

10. The bracket of claim 1, wherein the lock comprises a threaded fastener that extends through a threaded aperture of the outer member and an aperture of the inner member to contact a surface of the inner member thereby clamping the work surface between the inner member and outer member.

11. The bracket of claim 1, further comprising a work implement connected to the outer member.

12. The bracket of claim 11, wherein the work implement comprises one or more of a hook, trailer ball, trailer hitch, hitch receiver, fork, hydraulic cylinder mount, pivot point, open attachment points, bar receiver, or grapple.

13. A bracket for installation onto a bucket of a front end loader, the bracket configured for installation and removal from the bucket without the use of a tool, the bracket comprising: an inner member configured to be received by the bucket, an outer member configured to be located around portions of the inner member and the bucket, and a lock configured to extend through a portion of the inner member and the outer member without extending through the bucket when the bracket is installed onto the bucket to securely install the bracket onto the bucket and maintain the outer member and the inner member from moving relative to one another when installed onto the bucket.

14. The bracket of claim 13, wherein during use of the bracket to perform work, a work load is applied to the bracket to pinch the bucket between the inner member and the outer member and securely retain the bracket against movement relative to the bucket.

15. The bracket of claim 13, wherein in the absence of the work load the bucket is not pinched between the inner member and the outer member and the bracket is movably positionable relative to the bucket.

16. The bracket of claim 13, wherein in the absence of the work load the bucket is pinched between the inner member and the outer member by force applied from one or more threaded fasteners preventing movement relative to the bucket.

17. The bracket of claim 13, wherein the lock comprises a pin or threaded fastener that extends through an aperture of the outer member and an aperture of the inner member.

18. The bracket of claim 13, further comprising a work implement connected to the outer member.

19. The bracket of claim 18, wherein the work implement comprises one or more of a hook, trailer ball, trailer hitch, hitch receiver, fork, hydraulic cylinder mount, pivot point, open attachment points, bar receiver, or grapple.

20. A method for installing and using a bracket relative to a work surface, the method comprising the steps of: providing a bracket comprising an inner member configured to be received by the work surface, an outer member configured to be located around portions of the inner member and the work surface, installing the bracket onto the work surface by locating the inner member on the work surface and locating the outer member around portions of the inner member and the work surface, and positioning a lock to extend through a portion of the inner member and the outer member without extending through the work surface to securely install the bracket onto the work surface and complete installation of the bracket onto the work surface, wherein when the bracket is installed onto the work surface the bracket is movable relative to the work surface in the absence of a work load, and wherein during use of the bracket to perform work, a work load is applied to the bracket to pinch the work surface between the inner member and the outer member and securely retain the bracket against movement relative to the work surface.

21. The method of claim 20, further including the step of utilizing a threaded fastener to apply tension between the inner member and outer member or between the outer member and work surface, wherein the tension is operative to inhibit movement between the inner member and the outer member in the absence of work load.

22. The method of claim 20, wherein the work surface comprises a bucket or a blade of a front end loader.

23. The method of claim 20, wherein the step of positioning a lock comprises positioning a pin or bolt to extend through an aperture of the outer member and an aperture of the inner member.

24. The method of claim 20, further comprising a work implement connected to the outer member.

25. The method of claim 20, wherein the work implement comprises one or more of a hook, trailer ball, trailer hitch, hitch receiver, fork, hydraulic cylinder mount, pivot point, open attachment points, bar receiver, or grapple.

* * * * *